US009074568B2

(12) United States Patent
Kang et al.

(10) Patent No.: US 9,074,568 B2
(45) Date of Patent: Jul. 7, 2015

(54) INJECTION SYSTEM OF A FUEL INJECTION PUMP

(75) Inventors: Sang Lip Kang, Seoul (KR); Ju Tae Kim, Ulsan (KR); Kwang Hean An, Ulsan (KR); Dong Hun Kim, Ulsan (KR); Wook Hyeon Yoon, Ulsan (KR); Yong Seok Lee, Ulsan (KR); Hyun Chun Park, Ulsan (KR)

(73) Assignee: HYUNDAI HEAVY INDUSTRIES CO., LTD. (KR)

( * ) Notice: Subject to any disclaimer, the term of this patent is extended or adjusted under 35 U.S.C. 154(b) by 276 days.

(21) Appl. No.: 13/522,244

(22) PCT Filed: Sep. 13, 2010

(86) PCT No.: PCT/KR2010/006219

§ 371 (c)(1),
(2), (4) Date: Jul. 13, 2012

(87) PCT Pub. No.: WO2011/087201

PCT Pub. Date: Jul. 21, 2011

(65) Prior Publication Data

US 2013/0015274 A1 Jan. 17, 2013

(30) Foreign Application Priority Data

Jan. 15, 2010 (KR) ..... 10-2010-0003785

(51) Int. Cl.
*B05B 1/30* (2006.01)
*F02M 59/26* (2006.01)

(52) U.S. Cl.
CPC ..... *F02M 59/265* (2013.01); *F02M 59/26* (2013.01); *F02M 2200/315* (2013.01)

(58) Field of Classification Search
CPC ..... F02M 59/10; F02M 59/26; F02M 59/265; F07B 7/14
USPC ..... 239/88–93, 533.2, 584; 123/495–504
See application file for complete search history.

(56) References Cited

U.S. PATENT DOCUMENTS 2,565,681 A * 8/1951 Fleck et al. ..... 123/459
4,163,634 A * 8/1979 Powers ..... 417/499

(Continued)

FOREIGN PATENT DOCUMENTS

CN 2203365 7/1995
CN 1372074 10/2002

(Continued)

OTHER PUBLICATIONS

Chinese Patent Office-Chinese patent application No. 201080065073.9 issued on Feb. 20, 2014.

(Continued)

*Primary Examiner* — Davis Hwu
(74) *Attorney, Agent, or Firm* — Cantor Colburn LLP

(57) ABSTRACT

The injection system of a fuel injection pump is provided. In the injection system of a fuel injection pump, a plunger performs a reciprocating slide motion in the axial direction inside of the plunger chamber of a barrel for compressing fuel. The plunger has a release groove and a control edge. A spill port is formed in the wall surface of the barrel. A damping groove is formed in the upper-part outer circumference of the control edge and provides a fine fuel flow path. The damping groove meets the spill port in advance to form the fine flow of fuel from the plunger chamber to the spill port before the control edge of the plunger meets the spill port to release pressure.

1 Claim, 6 Drawing Sheets

(56) References Cited

U.S. PATENT DOCUMENTS

| | | | | | |
|---|---|---|---|---|---|
| 4,964,789 | A | * | 10/1990 | Schueler et al. | 417/494 |
| 5,209,208 | A | * | 5/1993 | Siebert et al. | 123/503 |
| 5,638,793 | A | * | 6/1997 | Rapp et al. | 123/500 |
| 5,680,988 | A | * | 10/1997 | Patil et al. | 239/90 |
| 6,009,850 | A | * | 1/2000 | DeLuca | 123/299 |

FOREIGN PATENT DOCUMENTS

| | | | |
|---|---|---|---|
| GB | 411353 | * | 6/1934 |
| JP | 08210222 | | 8/1996 |
| JP | 2723588 | B2 | 3/1998 |
| KR | 2019980047541 | | 9/1998 |
| KR | 200231110 | | 5/2001 |
| KR | 1020060074115 | | 7/2006 |

OTHER PUBLICATIONS

International Search Report-PCT/KR2010/006219 dated Apr. 25, 2011.

Written Opinion-PCT/KR2010/006219 dated Apr. 25, 2011.

* cited by examiner

INJECTION SYSTEM OF A FUEL INJECTION PUMP

TECHNICAL FIELD

The present disclosure relates to an injection device for a diesel fuel injection pump, and more particularly, to an injection device for a diesel fuel injection pump, which forms a minute flux in advance just before regular pressure relief to protect a wall of a spill port in order to prevent cavitation and a high-speed jet flow from colliding the wall of the spill port and to prevent resultant minute bubbles collapsing near the wall in order to minimize the damage of the spill port.

BACKGROUND ART

In an internal combustion engine using diesel as a fuel, a fuel injection pump compresses the fuel into high pressure and delivers the fuel to an injector installed at a combustion chamber. An injection device for substantially compressing and delivering the fuel includes a plunger and a barrel. The injection device compresses and delivers the fuel when the plunger serving as a piston reciprocates in the barrel serving as a cylinder.

A configuration of the injection device including a plunger and a barrel will be described with reference to FIGS. 1 and 2. A plunger 100 is inserted into a barrel 200 to slidably reciprocate in the axial direction (namely, in the vertical direction).

The plunger 100 is operated to reciprocate by a cam of a cam shaft (not shown) installed at the injection pump. A relief groove 102 communicating with a plunger chamber 202 and a control edge 104 communicating with the relief groove 102 are formed at the plunger 100.

The barrel 200 has a plunger chamber 202 and a fuel feeding/distributing chamber 204 formed at its inside and outside, respectively, and a spill port 206 for communicating the plunger chamber 202 with the fuel feeding/distributing chamber 204 is formed at the barrel 200.

In FIGS. 1 and 2, when the plunger 100 descends so that its upper surface is located below the spill port 206, a fuel flows through the spill port 206 into the plunger chamber 202, and the fuel starts being compressed from the point when the plunger 100 ascends so that its outer circumference closes the spill port 206. If the pressure reaches a predetermined level, a delivery valve at the upper portion of the plunger chamber 202 is opened so that the compressed fuel is transferred to the injector.

Subsequently, if the plunger 100 ascends further so that the control edge 104 encounters the spill port 206, the high-pressure fuel in the plunger chamber 202 leaks through the relief groove 102 and the control edge 104 to the spill port 206, thereby releasing pressure.

As described above, in the fuel compressing and releasing procedure, the process of compressing the fuel over about 800 bars and releasing the pressure to about 3 bars is periodically repeated.

Here, since the fuel pressure is relieved by the spill port 206, at the instant that the spill port 206 is opened, a high-speed fuel flow occurs due to a great pressure difference as described above, and accordingly the rapidly flowing fuel collides with the wall of the spill port 206, which causes erosion.

In addition, if the static pressure of the fuel is lowered due to the high-speed flow of the fuel to be equal to or lower than a vapor pressure, cavitation phenomenon which generates minute bubbles occurs. With the relief pressure, these bubbles burst at the outer circumference of the plunger 100, the inner surface of the barrel 200 and the surface of the spill port 206. Therefore, the cavitation erosion occurs at the surfaces of the plunger 100, the plunger chamber 202 and the spill port 206, which becomes a factor of pressure leakage and deteriorates the durability of the injection device.

DISCLOSURE

Technical Problem

The present disclosure is directed to solving the above problems. When pressure is relieved, right before a control edge and a spill port of a plunger are opened, a minute flux parallel to a spill port is formed in advance by a damping groove.

Due to the minute flux, the walls of the spill port and the plunger are surrounded by a kind of flux film and protected.

Therefore, it is possible to prevent a jet flow from rapidly colliding with an inlet/outlet portion, and also it is possible to suppress collapse of minute bubbles generated by cavitation near the walls, thereby minimizing the damage of the injection device and improving the durability.

Technical Solution

In one general aspect, the present disclosure provides an injection device for a fuel injection pump, where a plunger slidably reciprocates in a plunger chamber of a barrel to compress a fuel, wherein a relief groove communicating with the plunger chamber and a control edge communicating with the relief groove are formed at the plunger, wherein a spill port is formed at a wall of the barrel to communicate with the plunger chamber and a fuel feeding/distributing chamber, the spill port allowing pressure of the plunger chamber to leak out by contacting the control edge, and wherein a damping groove connected to an upper end surface of the plunger or the relief groove to provide a minute flux passage of the fuel is formed at an upper outer circumference of the control edge, so that the damping groove encounters the spill port in advance to form a minute flux of the fuel from the plunger chamber to the spill port before the control edge of the plunger encounters the spill port to provide a full-scale relief of pressure.

In the injection device of the present disclosure, the damping groove may be formed in at least two rows, and an entire width of at least two rows of the damping grooves may be smaller than a diameter of an inlet/outlet portion of the spill port.

Advantageous Effects

When the injection pump of the present disclosure is used, right before a control edge and a spill port of a plunger are opened so that shortly before a full scale relief of pressure, a minute flux is formed in advance by a damping groove.

Due to the minute flux, an abrupt jet flow is not formed from the plunger chamber to the spill port, and the pressure does not drop abruptly.

Therefore, it is possible to prevent a jet flow from rapidly colliding with an inlet/outlet portion, and also it is possible to prevent cavitation from being generated due to a pressure drop, thereby minimizing the damage of the injection device and improving the durability.

BEST MODE

Figure 1:
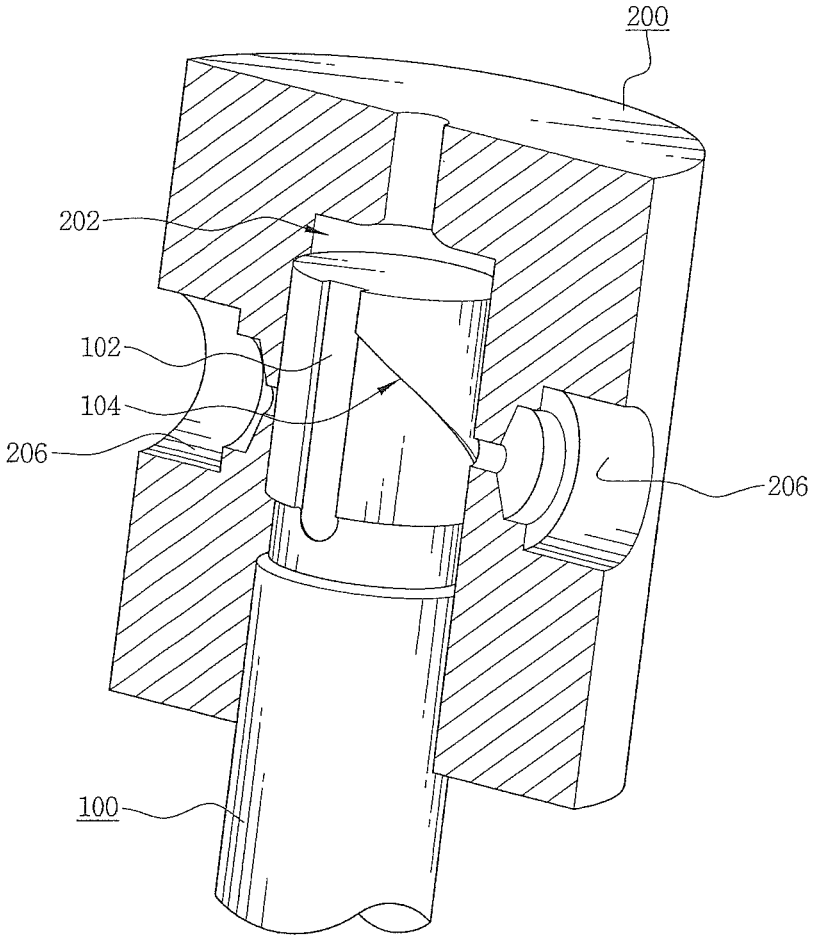
FIG. 1 (PRIOR ART)
FIG. 1 is a perspective sectional view showing a configuration of a conventional injection device.
Figure 2:
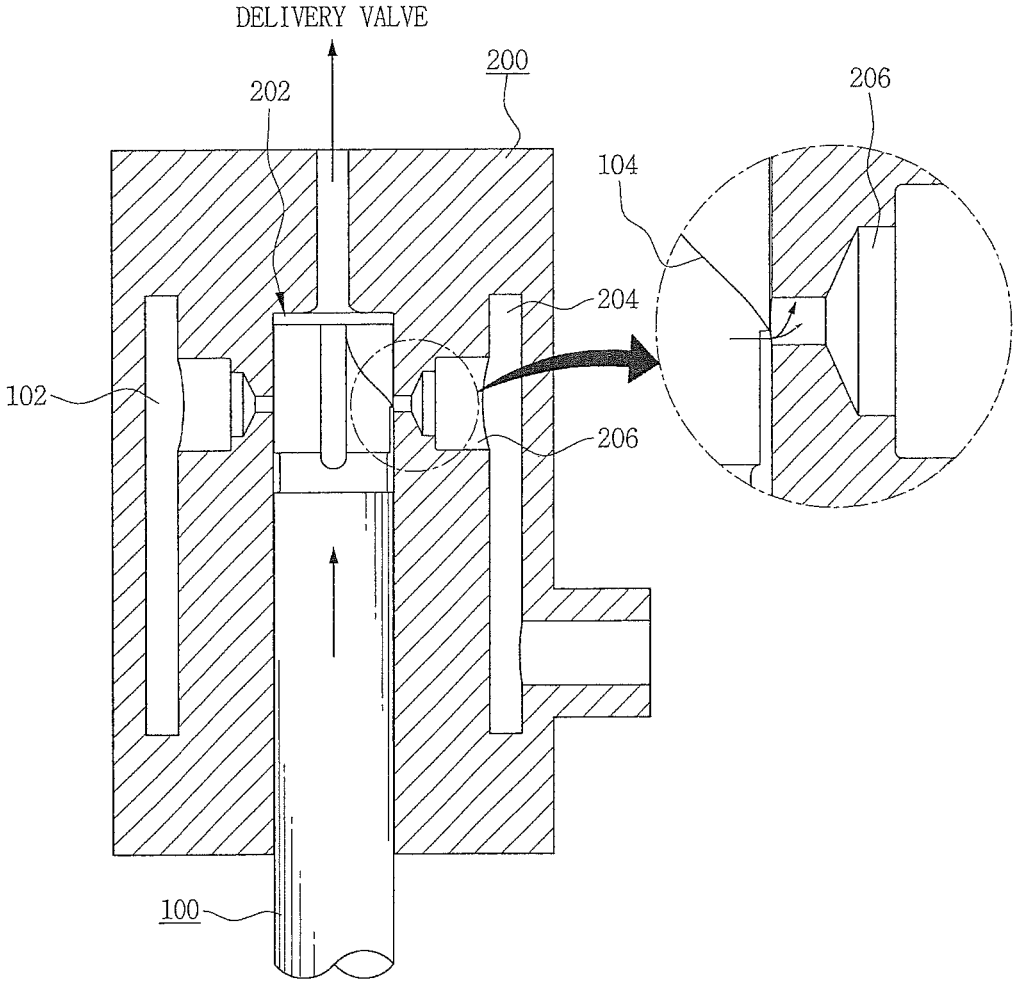
FIG. 2 (PRIOR ART)
FIG. 2 is a front sectional view showing a configuration of the conventional injection device.

Hereinafter, preferred embodiments of the present disclosure will be described in detail with reference to accompanying drawings. The same components as in FIGS. 1 and 2 will be designated by the same reference numerals.

Figure 3:
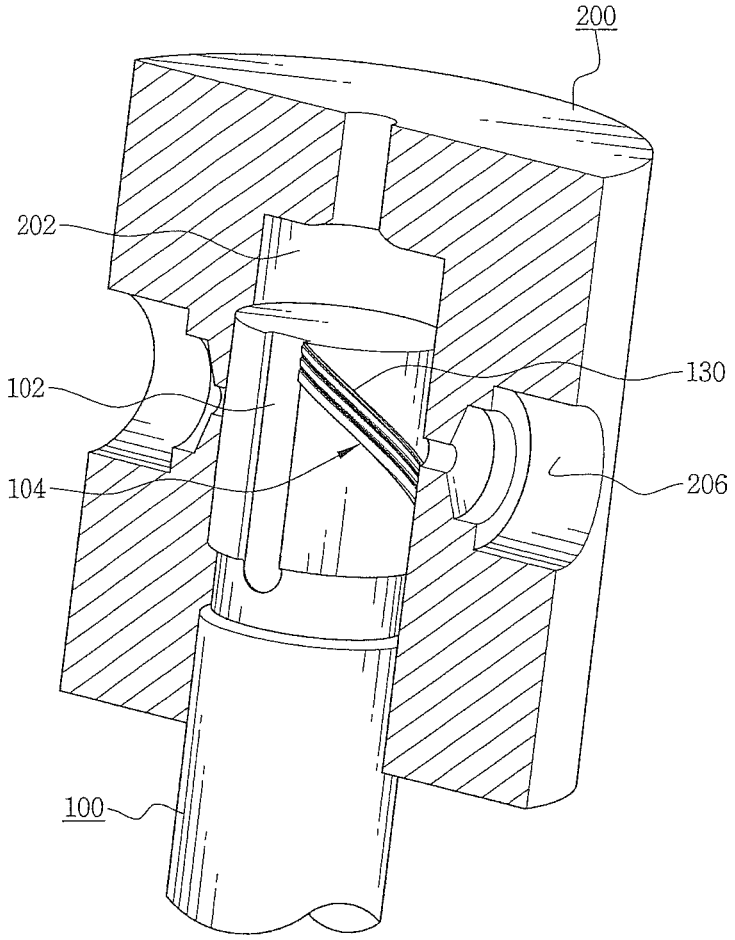
FIG. 3 is a perspective sectional view showing a configuration of an injection device according to the present disclosure.
Figure 4:
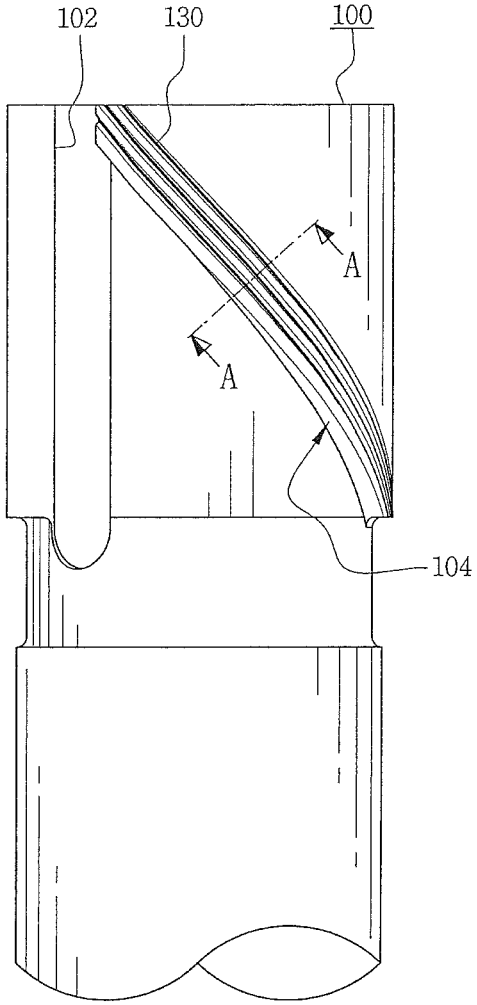
FIG. 4 is a perspective view showing a plunger employed in the injection device of FIG. 3.
Figure 5:
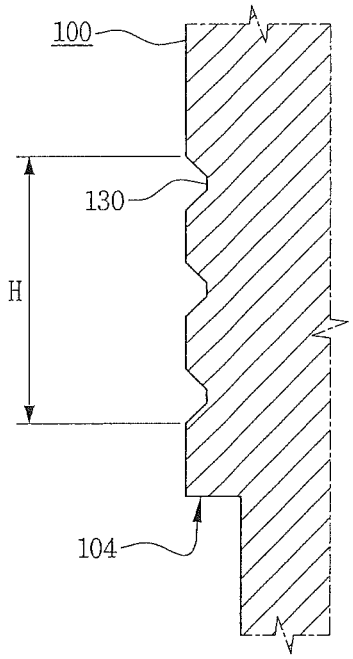
FIG. 5 is a cross-sectional view taken along the line A-A of FIG. 4.
Figure 6:
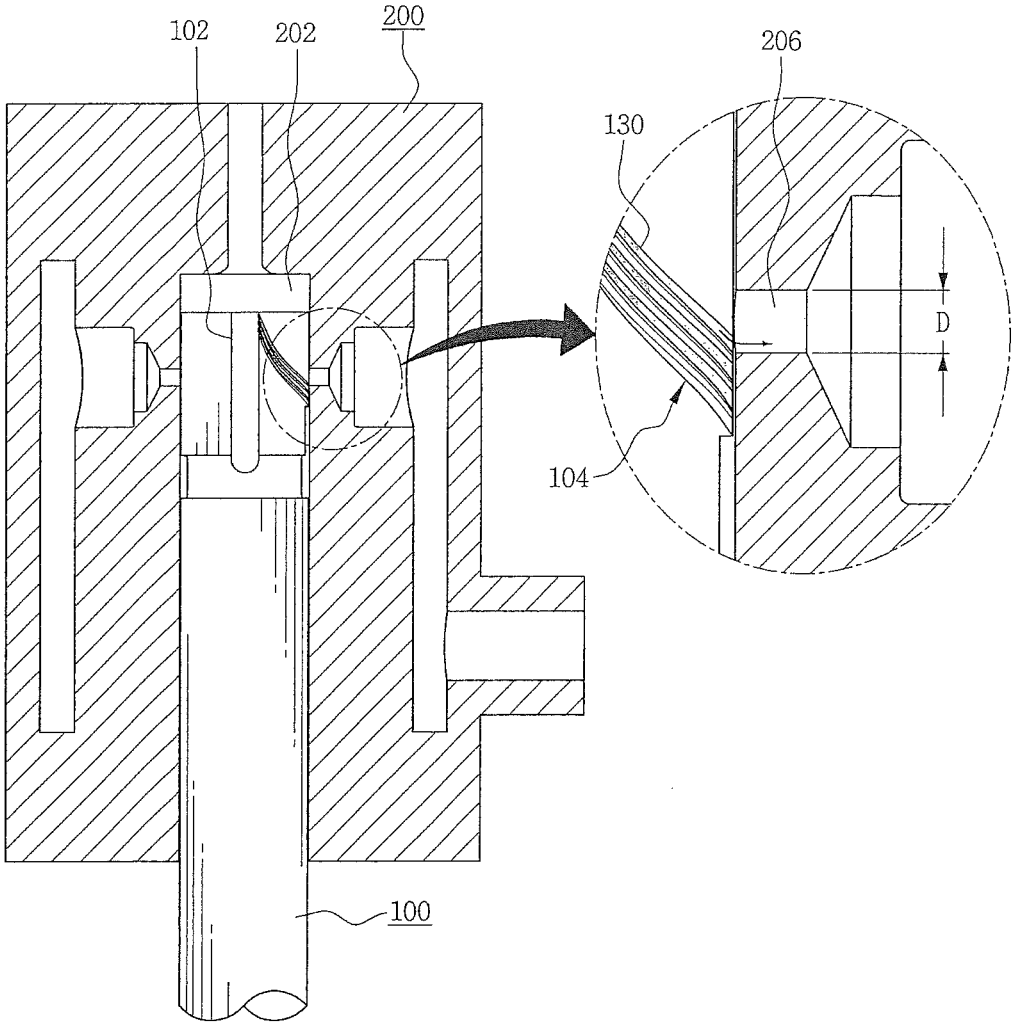
FIG. 6 is a diagram for illustrating a flux formed by a damping groove.

FIGS. 3 to 6 show an injection device according to the present disclosure, where FIG. 3 is a perspective sectional view showing the injection device, FIG. 4 is a perspective view showing a plunger, FIG. 5 is a cross-sectional view taken along the line A-A of FIG. 4, and FIG. 6 is a diagram for illustrating a flux formed by a damping groove.

First, as shown in FIGS. 3 to 5, in the injection device according to the present disclosure, a relief groove 102 communicating with a plunger chamber 202 of a barrel 200 and a control edge 104 communicating with the relief groove 102 are formed at a plunger 100, and the barrel 200 has a plunger chamber 202 formed at its inside and a fuel feeding/distributing chamber 204 formed at its outside. A spill port 206 for communicating the plunger chamber 202 with the fuel feeding/distributing chamber 204 is also formed at the barrel 200.

In the plunger 100, a damping groove 130 is formed at an upper outer circumference of the control edge 104.

The damping groove 130 is configured to connect to the upper end surface of the plunger 100 or the relief groove 102, and by doing so, pressure leaks from the plunger chamber 202 when the damping groove 130 encounters the spill port 206.

The damping groove 130 encounters the spill port 206 to communicate the plunger chamber 202 with the spill port 206, just before the control edge 104 of the plunger 100 encounters the spill port 206 to provide a full-scale relief of pressure.

Several damping grooves 130 may be formed. When several damping grooves 130 are formed, the entire width H (see FIG. 5) of the damping grooves 130 is smaller than the diameter D of an inlet/outlet portion of the spill port 206.

Even though the damping groove 130 is formed parallel to the control edge 104 in this embodiment, the damping groove 130 may have various angles and directions, without being limited thereto.

In the present disclosure configured as above, since the damping groove 130 encounters the spill port 206 to form a minute flux in advance just before the control edge 104 of the plunger 100 encounters the spill port 206 to provide a full-scale relief of pressure, it is possible to prevent the fuel from rapidly colliding with the wall of the spill port 206 and it is also possible to prevent minute bubbles, which is a main factor of erosion due to cavitation, from collapsing near the wall, thereby preventing the injection device from being eroded and damaged.

This will be described in detail below with reference to FIG. 6.

(1) Erosion Caused by Direct Impact of a High-Speed Jet Flow

When the control edge 104 encounters the spill port 206 and is opened at the last stage of the compression cycle of the plunger 100 as shown in FIG. 6, a high-speed jet flow over 500 m/s is generated due to a great pressure difference between the plunger chamber 202 and the fuel feeding/distributing chamber 204.

Particularly, since such a jet flow tends to be generated periodically in a fuel injection pump due to the reciprocation of the plunger 100, as the length of the spill port 206 increases, more fatigue is accumulated at the inner wall surface of the spill port, which is directly collided with the jet flow, and so the spill port is resultantly damaged by erosion.

In order to avoid such damage, a method of allowing a high-speed jet flow to flow without contacting the wall of the spill port 206 has been studied as a measure.

According to the present disclosure, at the last stage of the compression cycle of the plunger 100, the damping groove 130 encounters the spill port 206 to communicate the plunger chamber 202 with the spill port 206 before the control edge 104 encounters the spill port 206 and is opened with full-scale, and by doing so, a minute flux (a small amount of thin flux) is firstly formed along the damping groove 130 in a direction parallel to the spill port.

The high-speed minute flux of the small amount of fuel gives an effect of protecting the inner wall surface of the spill port 206 as a kind of flux film. Therefore, afterwards, the minute flux prevents a large amount of high-speed jet flow, generated when the control edge is opened, from directly colliding with the wall of the spill port. For this reason, when the jet flow reaches the wall of the spill port 206, the speed of the jet flow greatly decreases, the intensity of the jet flow is weakened, and the flowing direction of the jet flow is biased outwards in the radial direction of the spill port 206, thereby eventually preventing the wall of the spill port 206 from being eroded.

(2) Erosion Caused by Indirect Impact Due to the Generation of a Cavitation

When the control edge 104 encounters the spill port 206 and is opened at the last stage of the compression cycle of the plunger 100 as shown in FIG. 6, a high-speed jet flow over 500 m/s is generated due to a great pressure difference between the plunger chamber 202 and the fuel feeding/distributing chamber 204, and the high speed of the jet flow drops the pressure, which generates cavitation.

According to the present disclosure, since the damping groove 130 encounters the spill port 206 to form a minute flux in advance just before the control edge 104 of the plunger 100 encounters the spill port 206 to provide a full-scale relief of pressure, the high pressure of the plunger chamber 202 is slowly relieved in advance, and the minute flux forms a kind of flux film which protects the walls of the spill port and the plunger.

Therefore, since the pressure of the plunger chamber 202 is significantly relieved in advance at the point when the control edge 104 encounters the spill port 206, the speed of the fuel greatly decreases, the pressure does not drop abruptly, and the flux film prevents minute bubbles known as a main factor of erosion caused by cavitation from being generated and also prevents the minute bubbles from collapsing near the walls, eventually decreasing the cavitation and resultant damage.

The embodiments of the present disclosure have been described in detail with reference to the accompanying drawings. However, these embodiments are just preferred examples, and the scope of the present disclosure is not limited by the embodiments. In addition, those skilled in the art will appreciate that the embodiments may be readily utilized as a basis for modifying or designing other equivalent embodiments of the present disclosure, and these modifications and equivalents do not also depart from the spirit and scope of the disclosure as set forth in the appended claims.

INDUSTRIAL APPLICABILITY

When the injection pump of the present disclosure is used, right before a control edge and a spill port of a plunger are opened, a minute flux is formed in advance by a damping groove.

Due to the minute flux, an abrupt jet flow is not formed from the plunger chamber to the spill port, and the pressure does not drop abruptly.

Therefore, it is possible to prevent a jet flow from rapidly colliding with an inlet/outlet portion, and also it is possible to prevent cavitation from being generated due to a pressure drop, thereby minimizing the damage of the injection device and improving the durability.

The invention claimed is:

1. An injection device for a fuel injection pump, where a plunger (100) slidably reciprocates in a plunger chamber (202) of a barrel (200) to compress a fuel, wherein a relief groove (102) communicating with the plunger chamber (202) and a control edge (104) communicating with the relief groove (102) are formed at the plunger (100), wherein a spill port (206) is formed at a wall of the barrel (200) to communicate with the plunger chamber (202) and a fuel feeding/distributing chamber (204), the spill port (206) allowing the fuel in the plunger chamber (202), when pressurized, to leak out by contacting the control edge (104), and wherein a damping groove (130) connected to an upper end surface of the plunger (100) or the relief groove (102) to provide a minute flux passage of the fuel is formed at an upper outer circumference of the control edge (104), so that the damping groove (130) encounters the spill port (206) in advance to form a minute flux of the fuel from the plunger chamber (202) to the spill port (206) before the control edge (104) of the plunger (100) encounters the spill port (206) to achieve a full-scale release of the pressure of the fuel; and wherein an entire width (H) of at least two rows of the damping grooves (130) is formed parallel to the control edge (104) and is smaller than a diameter (D) of an inlet/outlet portion of the spill port (206).

* * * * *